United States Patent [19]

Shiozaki et al.

[11] Patent Number: 4,964,381

[45] Date of Patent: Oct. 23, 1990

[54] FUEL INJECTION FEATURES OF A TWO-CYCLE ENGINE FOR MOTORCYCLES

[75] Inventors: Tomoo Shiozaki; Yoshiyuki Kawaguchi; Yasuhiko Nakano; Yusuke Gotoda; Hiroo Takemura, all of Saitama, Japan

[73] Assignee: Honda Giken Kogyo Kabushiki Kaisha, Tokyo, Japan

[21] Appl. No.: 386,559

[22] Filed: Jul. 27, 1989

[30] Foreign Application Priority Data

Jul. 29, 1988 [JP] Japan ..... 63-188300
Aug. 5, 1988 [JP] Japan ..... 63-194543

[51] Int. Cl.[5] ..... F02B 33/04

[52] U.S. Cl. ..... 123/73 A; 123/299; 123/305

[58] Field of Search ..... 123/73 R, 73 A, 299, 123/472, 73 B, 73 C, 301, 305

[56] References Cited

U.S. PATENT DOCUMENTS

| | | | |
|---|---|---|---|
| 4,290,394 | 9/1981 | Frank et al. | 123/73 A |
| 4,461,260 | 7/1984 | Nanako et al. | 123/73 A |
| 4,592,311 | 6/1986 | Makino | 123/73 A |
| 4,608,949 | 9/1986 | Nakano et al. | 123/73 A |
| 4,711,201 | 12/1987 | Odyama et al. | 123/73 A |
| 4,779,581 | 10/1988 | Maier | 123/73 A |
| 4,817,570 | 4/1989 | Morita et al. | 123/472 |

FOREIGN PATENT DOCUMENTS

| | | | |
|---|---|---|---|
| 2928350 | 2/1981 | Fed. Rep. of Germany | 123/472 |
| 58-98632 | 6/1983 | Japan . | |
| 0058108 | 4/1984 | Japan | 123/73 V |
| 0255543 | 10/1988 | Japan | 123/472 |

*Primary Examiner*—David A. Okonsky
*Attorney, Agent, or Firm*—Irving M. Weiner; Robert M. Petrik; Joseph P. Carrier

[57] ABSTRACT

A fuel injection type two-cycle engine for motorcycles. A fuel injection valve for injecting fuel into an air intake passageway at a predetermined timing is disposed on the upstream side of a reed valve in the air intake passageway communicating with an interior of the engine via the reed valve, with the injection port thereof directed towards the reed valve. An air intake pipe forming the air intake passageway extends nearly in the vertical direction from the upper surface of a crank case at an middle position between a crank shaft extending in the widthwise direction of the vehicle body and a transmission shaft separated from the crank shaft in the back and forth direction and extending in the widthwise direction of the vehicle body, and a fuel injection valve protrudes from this air intake pipe in the back and forth direction. The air intake pipe and the fuel injection valve are positioned between left and right vehicle body frame members above the engine, and a partition plate is provided between the vehicle body frame members and the engine main body.

12 Claims, 7 Drawing Sheets

FUEL INJECTION FEATURES OF A TWO-CYCLE ENGINE FOR MOTORCYCLES

BACKGROUND OF THE INVENTION

1. Field of the Invention

The present invention relates to a fuel injection type two-cycle engine for motorcycles and a motorcycle loaded with this engine.

2. Description of the Relevant Art

In a reed valve type two-cycle engine, a thin-plate-shaped reed valve which opens as attracted towards the side of a crank chamber in accordance with a pressure difference between the inside and the outside of the crank chamber produced by a piston motion and closes due to its own resilient force when the pressure difference has been lowered, is disposed at a suction port portion provided at the crank chamber or a cylinder portion and communicated with an air intake passageway, so that air would be sucked into the engine when the reed valve opens. Fuel is fed into the sucked air within the air intake passageway, and an engine designed so as to perform this fuel feed by means of a fuel injection valve has been known, for instance, such an engine is disclosed in Laid-Open Japanese Patent Specification No. 58-98632.

In this engine, an amount of sucked air is detected on the basis of a magnitude of variation of an inner pressure within a crank chamber, and depending upon this detected value, an injection signal having a predetermined time width is output from a control device consisting of a digital computer or the like to a fuel injection valve. When the above-mentioned injection signal is input, the fuel injection valve opens only during the time width and injects an appropriate amount of fuel into the air intake passageway.

However, in the above-described fuel injection device in the prior art, since a jet port of the fuel injection port is directed towards the wall of the air intake passageway and the injected fuel is at first blown onto this wall, fuel would adhere onto the wall, hence mistification of fuel would be prevented, and waste of fuel was liable to occur.

In general, an engine for a motorcycle is desired to have a small width in view of its relation to a vehicle body, and also, as it is equipped by effectively utilizing a narrow space around a vehicle body frame, it is necessary to pay special attention to ease of maintenance and cooling of the engine and air intake.

SUMMARY OF THE INVENTION

One object of the present invention is to provide a fuel injection type two-cycle engine for motorcycles, wherein fuel injected from a fuel injection valve is surely fed to an engine in a mistified state, and hence waste of fuel would not occur.

Another object of the present invention is to provide a fuel injection type two-cycle engine for motorcycles, wherein the width of the entire engine is narrow, and when it is loaded on a motorcycle, maintenance is easy and effective cooling can be carried out.

According to the present invention, the above-mentioned first object is achieved by an engine wherein a fuel injection valve adapted to inject fuel into the aforementioned air intake passageway at a predetermined timing is disposed on the upstream side of the aforementioned reed valve in the air intake passageway with its injection port directed towards the aforementioned reed valve.

According to the present invention, since the injection port of the fuel injection valve is directed towards the reed valve, if the fuel injection timing is matched with the timing of opening the reed valve, fuel can be directly injected from the fuel injection valve through the opened reed valve into the engine. Accordingly, the fuel injected from the fuel injection valve can be surely fed to the engine in a mistified state, and there occurs no waste of fuel. In addition, response of an engine to fuel injection is improved, and for instance, breathing phenomena caused by delay of fuel feed upon abrupt opening of a throttle can be effectively prevented.

The above-described second object is achieved by an engine comprising a crank shaft extending within a crank case in the widthwise direction of a vehicle body, a transmission shaft extending within the crank case in the widthwise direction of the vehicle body as separated from the aforementioned crank shaft in the back and forth direction, an air intake pipe extending nearly in the vertical direction from the upper surface of the aforementioned crank case at a middle position between the above-mentioned crank shaft and the above-mentioned transmission shaft, and a fuel injection valve mounted to the aforementioned air intake pipe and extending in the back and forth direction from the air intake pipe.

In the above-described engine, since the air intake pipe is provided as erected in the vertical direction behind a cylinder protruding from the crank case on the side of the crank shaft, and moreover, since the fuel injection valve mounted to this air intake pipe extends in the back and forth direction from the air intake pipe, the air intake pipe and the fuel injection valve would not project sideways from the cylinder and the crank case, hence as viewed from the above, they are accommodated within a contour of the crank case, and accordingly, the width of the entire engine would not be broadened by the existence of the air intake pipe and the fuel injection valve.

Accordingly, this engine can be loaded on a motorcycle with the aforementioned air intake pipe and fuel injection valve extended through the space between vehicle body frames above the engine, and in this case, by providing a partition plate between the vehicle body frames and the engine, intake air can be prevented from being heated with heat generated by the engine, and also by guiding running wind from the front to the air intake pipe by means of this partition plate, the engine is made to suck low-temperature air and thereby a filling efficiency can be enhanced. In addition, since a fuel system including the fuel injection valve is disposed as concentrated at the location above the partition plate, maintenance is easy.

DETAILED DESCRIPTION OF THE PREFERRED EMBODIMENT

In the following, the present invention will be explained in connection to one preferred embodiment illustrated in the accompanying drawings.

Figure 1:
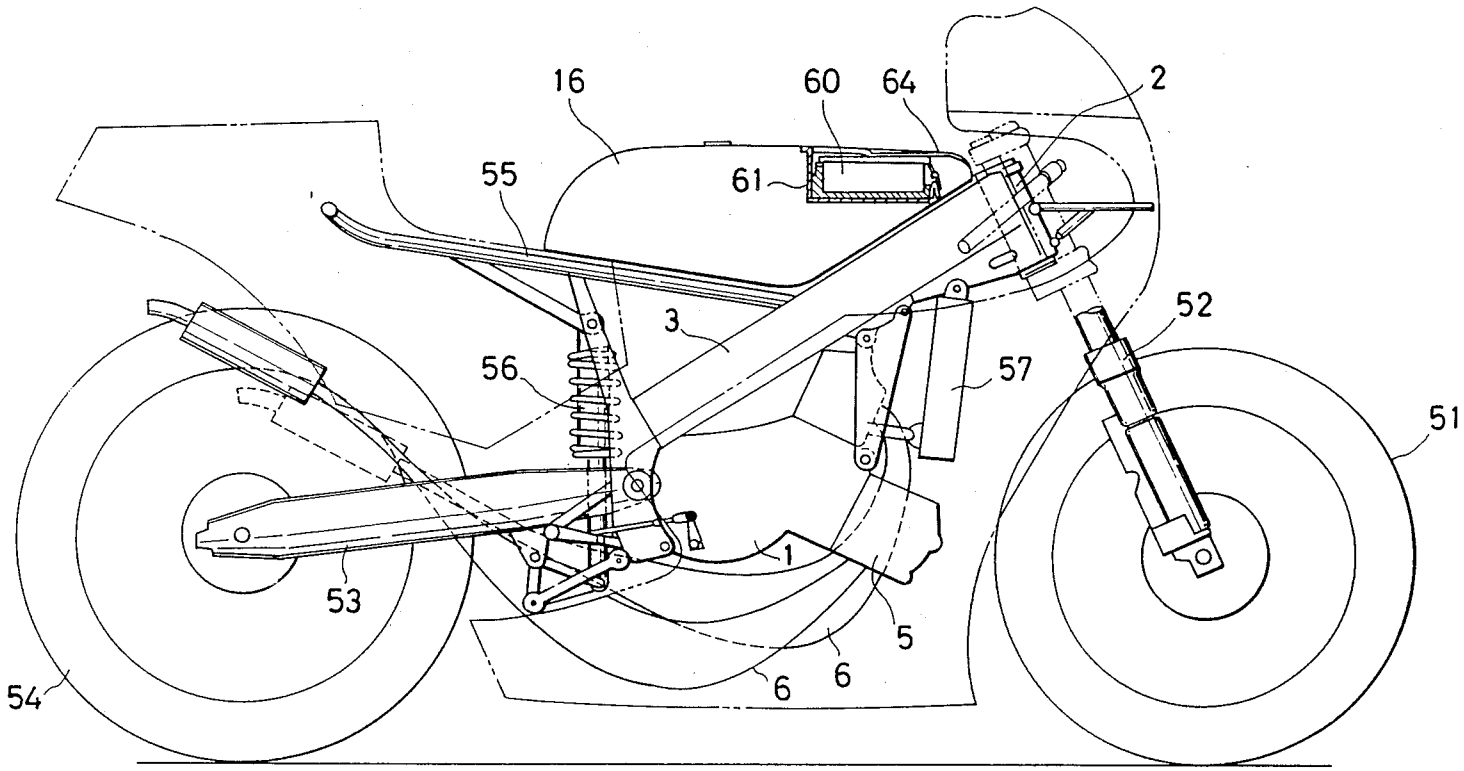
FIG. 1 is a general side view of a motorcycle loaded with an engine according to the present invention.

FIG. 1 is a general side view of a motorcycle loaded with an engine 1 according to the present invention. Main frame members 3 extend obliquely downwards and backwards from a head pipe 2 which supports a front wheel 51 via a front fork 52 in a freely steerable manner, and at the rear end portions of these main frame members 3 is supported a rear wheel 54 via a rear fork 53 in a vertically swingable manner. And between a seat rail 55 extending backwards from the middle portions of the main frame members 3 and the rear fork 53 is provided a rear cushion 56.

Figure 2:
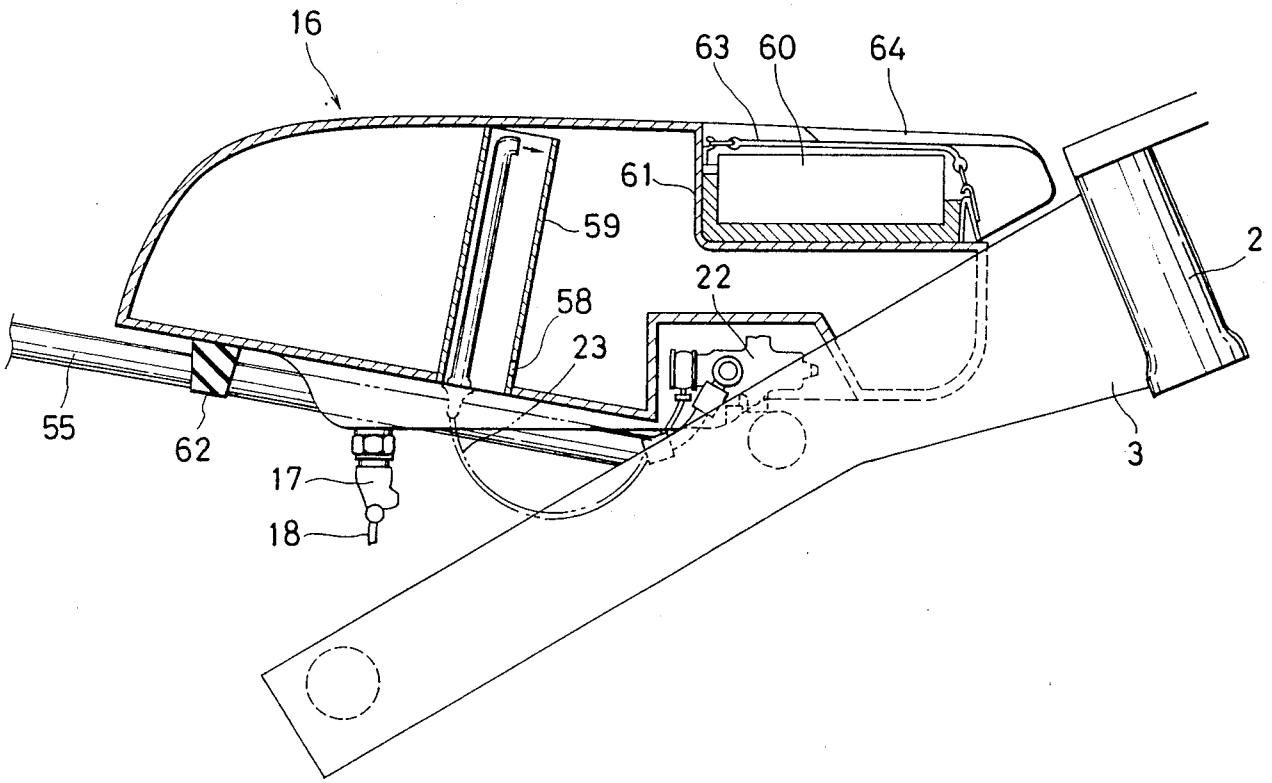
FIG. 2 is a longitudinal cross-section view of a fuel tank of the same motorcycle.

The engine 1 is loaded on a central lower portion of a vehicle body as suspended from the main frame members 3, and in front of the engine 1 is disposed a radiator 57. Above the engine 1 is disposed a fuel tank 16 as straddling the main frame members 3 and the seat rail 55 so as to cover the engine 1. Behind the fuel tank 16 is disposed a seat (not shown). FIG. 2 is a longitudinal cross-section view of the fuel tank 16.

Figure 3:
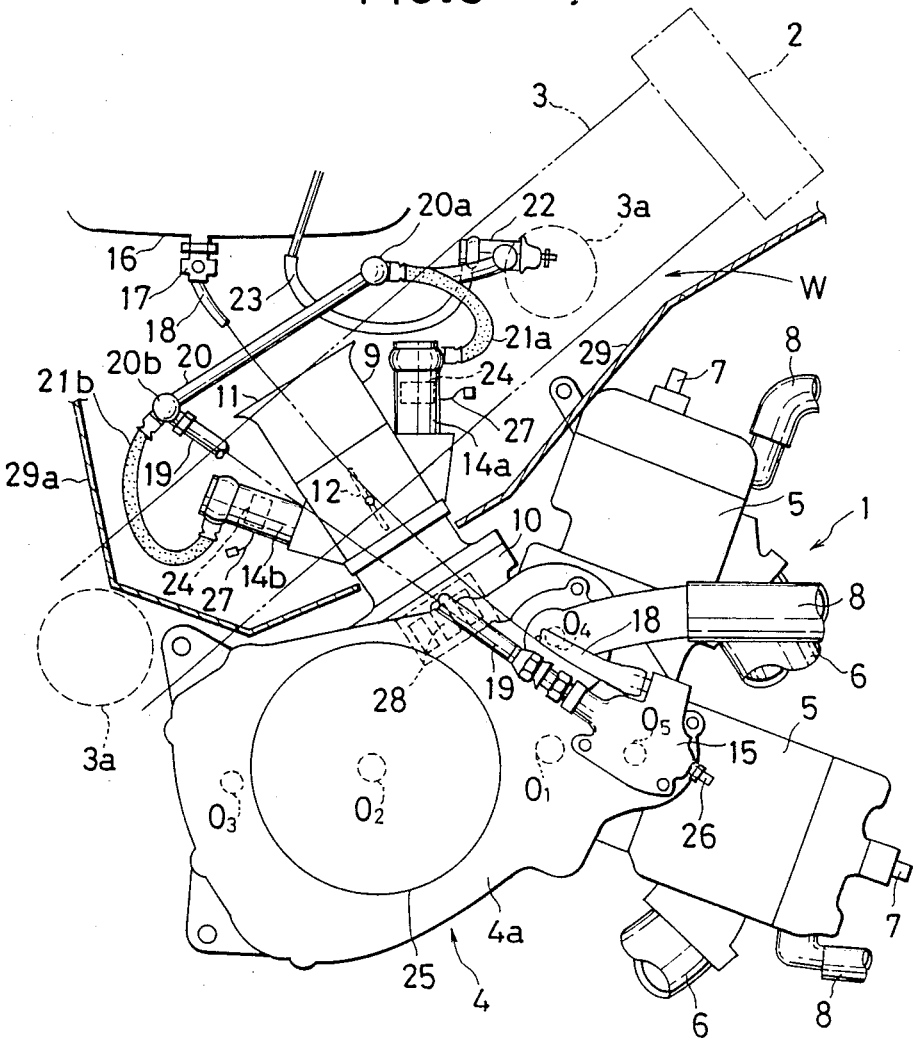
FIG. 3 is a side view of an engine according to one preferred embodiment of the present invention.
Figure 4:
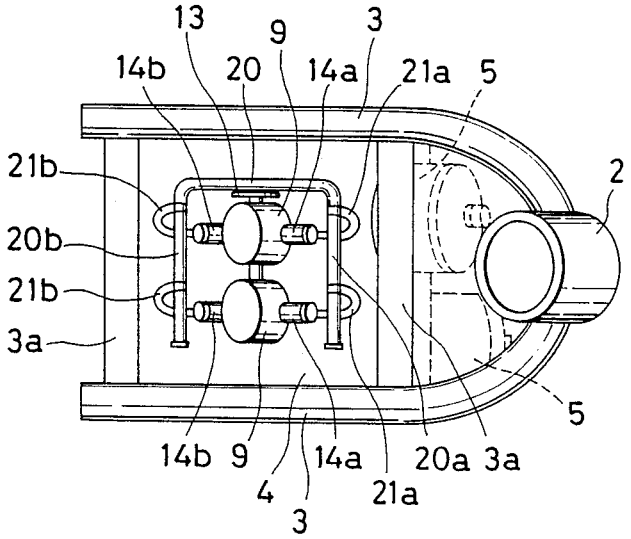
FIG. 4 is a schematic view of the same engine as viewed from the above.

FIG. 3 is a side view of the engine 1. The engine 1 is supported as suspended from a pair of left and right main frame members 3 having a rectangular cross-section and connected with each other via a cross pipe 3*a*. The engine 1 is a fuel injection type two-cycle engine of V-shaped two-cylinder class, in which two cylinders 5 protrude from the front portion of a crank case 4 as arrayed with respect to each other in a V-shape and juxtapositioned in the widthwise direction of the vehicle body. Reference numeral 6 designates an exhaust pipe which extends to the rear of the vehicle body as shown in FIG. 1. Reference numeral 7 designates an ignition plug, and numeral 8 designates a coolant water pipe connected to the radiator 57 (FIG. 1) disposed in front of the cylinder 5. Reference symbols $0_1$, $0_2$, $0_3$ and $0_4$ respectively designate a crank shaft, a transmission shaft, a transmission output shaft and a water pump shaft, and as seen from the figures, these shafts are directed in the widthwise direction of the vehicle body. The crank shaft $0_1$ and the transmission shaft $0_2$ are disposed as separated from each other in the back and forth direction. The interior of the crank case is partitioned into two crank chambers respectively corresponding to the left and right cylinders 5,5 by means of a central partition wall, the respective crank chambers are respectively provided with air intake ports 10, and air intake pipes 9 are respectively connected to these air intake ports 10 and extend upwards. The air intake ports 10 are provided on the upper surface (back surface) of the crank case 4 at a middle position between the crank shaft $0_1$ and the transmission shaft $0_2$, and accordingly, as shown in FIG. 4, the left and right air intake pipes 9,9 extend nearly in the vertical direction at the positions behind the respective corresponding cylinders 5,5. The upper end of the air intake pipe 9 forms an air intake 11 opening between the left and right main frame members 3. In the middle portion of the air intake pipe 9 is provided a throttle valve 12, and the air intake pipe 9 forms a throttle body supported by the crank case 4. To each air intake pipe 9 are respectively mounted a fuel injection valve 14*a* projecting forwards and a fuel injection valve 14*b* projecting backwards. Since these fuel injection valves 14*a* and 14*b* project in the back and forth directions from the air intake pipe 9 as described above, they would not interfere with the left and right main frame members 3,3, and also they would not interfere with members such as a throttle pulley provided on the side of the air intake pipe 9 for the purpose of operating the throttle valve 12.

On a side cover 4*a* covering a side portion of the crank case 4 is provided a fuel pump 15 which is interlocked with the crankshaft and mechanically driven by the crank shaft. Reference symbol $0_5$ designates a pump shaft of this fuel pump 15. Fuel within the fuel tank 16 disposed above the main frame members 3 is sucked through a cock 17 and a fuel suction pipe 18 into the fuel pump 15. Fuel delivered from the fuel pump is sent through a fuel delivery pipe 19 to a fuel feed pipe 20 made of metal.

The fuel suction pipe 18 and the fuel delivery pipe 19 are disposed so as to pass the above of a clutch cover portion 25 formed on the side cover 4*a* of the crank case 4 as projected sideways in order to cover the clutch within the crank case 4, also an air vent valve 26 provided in the fuel pump 15 for the purpose of venting air within the fuel system is disposed at the front portion of the fuel pump 15 as directed forwards, and thus it is attempted to reduce the entire width of the engine 1 by eliminating members protruding sideways from the engine 1 as much as possible.

Figure 5:
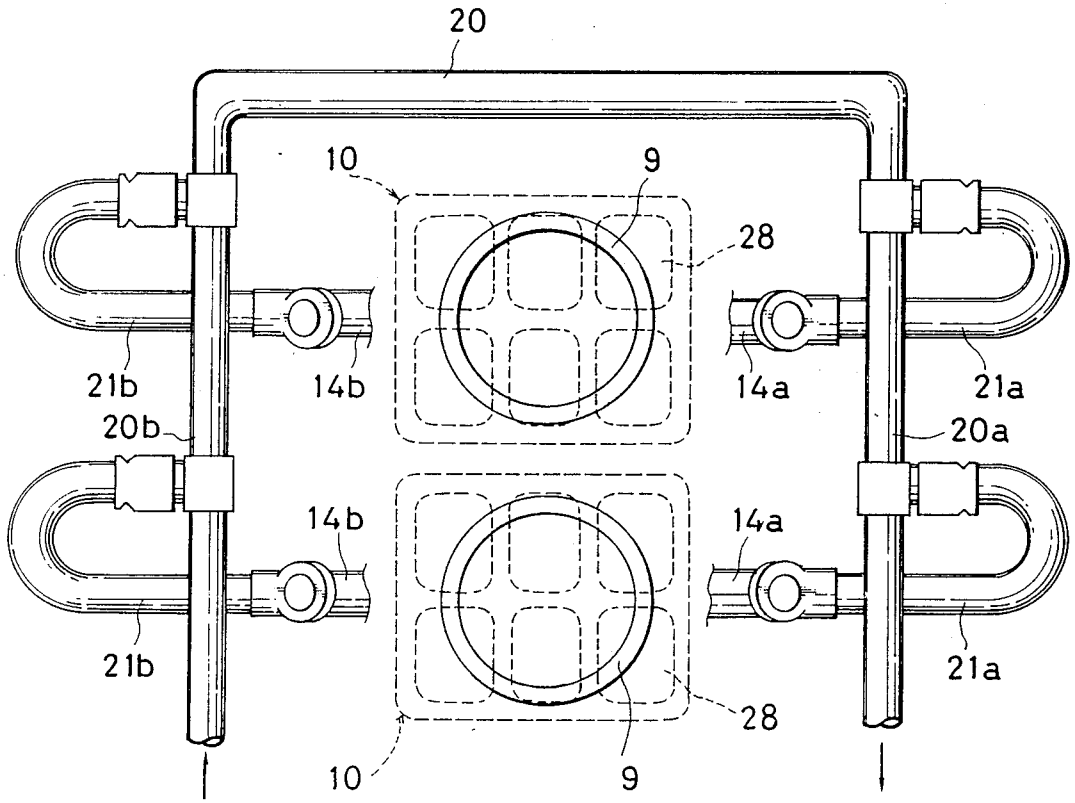
FIG. 5 is a schematic top view showing an air intake portion of the same engine.

As shown in FIGS. 4 and 5, the fuel feed pipe 20 is arranged in a U-shape so as to surround the left and right air intake pipes 9,9, and two connecting tubes 21*a* made of pressure-proof rubber hoses are branched from a front portion 20*a* of this fuel feed pipe 20 and connected respectively to the above-described fuel injection valves 14*a* on the front side of the left and right air intake pipes 9,9. From a rear portion 20*b* of the fuel feed pipe 20 are also branched two similar connecting tubes 21*b*, and they are respectively connected to the fuel injection valves 14*b* on the rear side of the air intake pipes 9,9. In addition, the fuel feed pipe 20 is provided with a pressure regulating valve 22, and by returning surplus fuel to the fuel tank 16 through a return tube 23 connected to this pressure regulating valve 22, a fuel pressure within the fuel feed pipe 20 would be maintained constant. As shown in FIG. 2, the return tube 23 rises within the fuel tank 16, so as to eject the return fuel from the top of the tube and a cylinder 59 having a communication hole 58 at its lower portion is disposed around the return tube 23, and thereby bubbling of fuel within the fuel tank 16 is prevented.

The fuel injection valve 14 contains therein electromagnetic opening/closing means 24 consisting of an electromagnetic solenoid or the like, and the fuel sent through the connecting tube 21 to the fuel injection valve 14 is injected from the fuel injection valve 14 into the air intake pipe 9 only when the electromagnetic opening/closing means is actuated to open the fuel injection valve 14. An electric signal is input to the electromagnetic opening/closing means 24 through an electric wire 27 and the electromagnetic opening/closing means 24 is actuated by this electric signal. The electric signal is controlled by an electronic control device in such manner that the electric signal may be input only at the timing when the reed valve 28 provided at the above-described air intake port 10 is opening and it may be sustained only during a period corresponding to a desired fuel feed amount at that time. Accordingly, when the reed valve 28 opens, fuel of the amount corresponding to the desired fuel feed amount is injected from the fuel injection valve 14, and efficient engine operation can be effected.

The above-mentioned electronic control device is well-known one consisting of an electronic circuit including a microcomputer and its interfaces, and its principal portion is assembled as a control unit (ECU) 60. To the control unit 60 are input signals sent from a throttle angle sensor, an engine rotational speed sensor, a crank angle sensor and the like disposed at the respective portions of the engine 1, and the control unit 60 processes these input signals by means of a microcomputer and sends the above-mentioned control signal to the fuel injection valve 14.

The control unit 60 is provided at the front end upper portion of the fuel tank 16 as shown in FIGS. 1 and 2.

More particularly, at the front end of the upper surface of the fuel tank 16 is formed a recessed portion of the shape conformed to the contour of the control unit 60, that is, a control unit loading section 61, and the control unit 60 is loaded on the loading section 61 via a cushion member. It is to be noted that the fuel tank 16 itself is also mounted to the vehicle body frame via a cushion member such as a rubber mount 62 or the like. The control unit 60 is firmly fixed on the control unit loading section 61 by means of a fastening band 63, and further the top of the control unit 60 is covered by an openable cover member 64.

It is to be noted that in the illustrated embodiment, since each air intake pipe 9 is provided with two front and rear fuel injection valves **14*a* and 14*b*, control is effected in such manner that upon low rotational speed low output operation, fuel may be injected only from, for instance, the front fuel injection valve 14*a*, and when it becomes a high rotational speed high output condition, the rear fuel injection valves 14*b* also may be opened and fuel may be injected from the two fuel injection valves 14*a* and 14*b***. If such provision is made, a fuel feed amount can be regulated over a broad range in accordance with an operating condition of the engine.

As shown in FIG. 3, between the main frame member 3 and the engine 1 is provided a partition plate 29, and this partition plate 29 extends forwards so as to cover the top of the cylinder 5 and the radiator 57 disposed in front of the cylinder 5. And the air intake pipe 9 extends upwards penetrating through this partition plate 29, and jointly with the fuel injection valves **14*a* and 14*b* it is positioned between the left and right main frame members 3**.

Accordingly, as the heat radiated from the cylinder 5 and the radiator 57 and the air heated by the heat are intercepted by the partition plate 29, the air intake pipe 9, the fuel injection valves 14 and the fuel system connected to the fuel injection valves 14 can be maintained at a low temperature. Furthermore, at the above of the partition plate 29, running wind $\omega$ is introduced through an opening provided appropriately in the front portion, the running wind $\omega$ reaches the neighborhood of the air intake pipe 9 as guided by the partition plate 29 and the main frame members 3 and cools this portion, and also the air is sucked into the engine through the air intake 11. Since low-temperature air can be fed in this way, a filling efficiency is improved, and further since the rear portion **29*a* of the partition plate 29 rises so as to block the rear of the air intake pipe 9, a dynamic pressure of air is produced in the proximity of the air intake 11 by this partition plate portion 29*a***, and owing to this dynamic pressure also, the filling efficiency is improved.

In addition, as the fuel system consisting of the fuel injection valves 14, the connecting tubes 21, the fuel feed pipe 20, the pressure regulating valve 22 and the like is provided as concentrated at the above of the partition plate 29, maintenance is easy.

Figure 6:
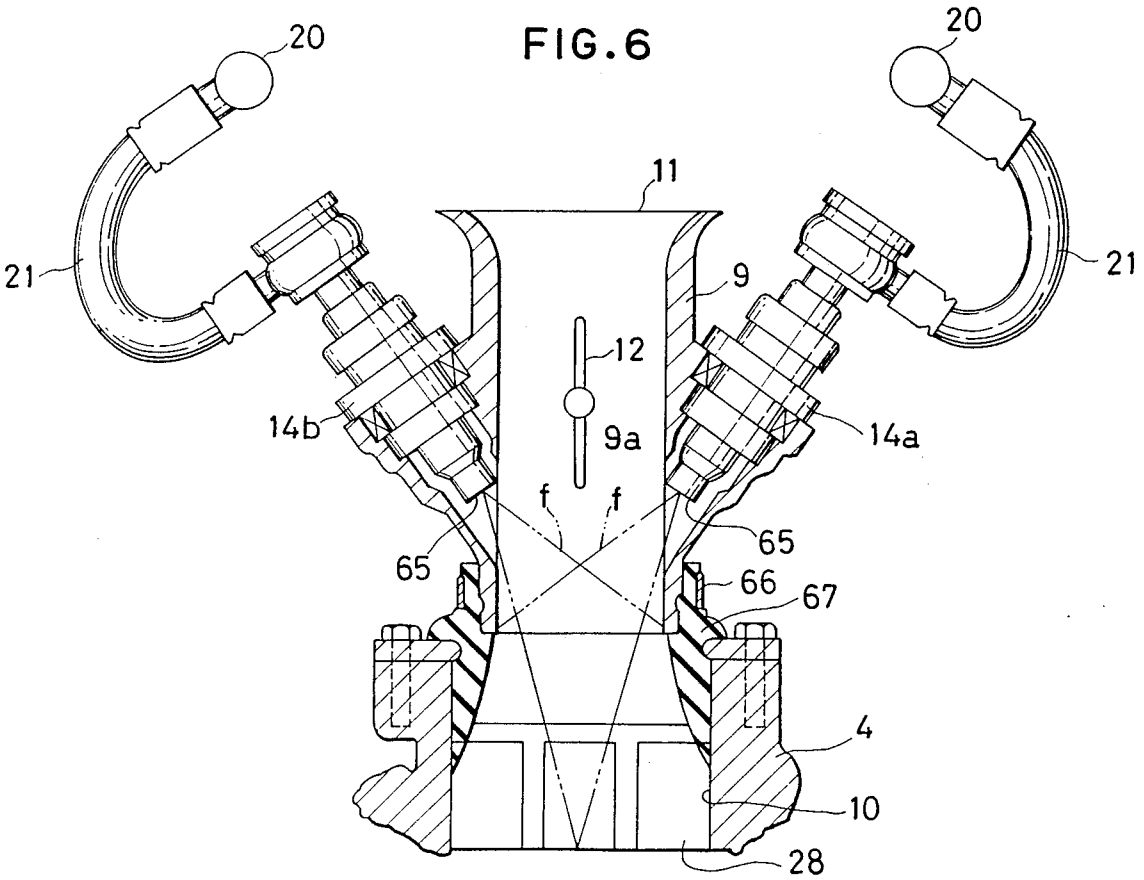
FIG. 6 is a longitudinal cross-section view of an air intake passageway.

As shown in FIG. 6, the air intake pipe 9 forming an air intake passageway **9*a* is mounted to an air intake port 10 via a rubber member 67 which is fixed to the outer circumferential surface of the air intake pipe 9 as fastened by means of a band 66. An injection port 65 of the fuel injection valve 14 faces the air intake passageway 9*a* at a middle position between the above-described throttle valve 12 and a reed valve 28, and the injection port 65 is directed towards the reed valve 28. More particularly, the axis of the injection port 65 inclines largely with respect to the axis of the air intake passageway 9*a***, and fuel *f* injected in a circular cone shape from the injection port 65, at least a most part thereof, would directly reach the reed valve 28 without striking against the wall of the air intake passageway **9*a***.

Figure 7:
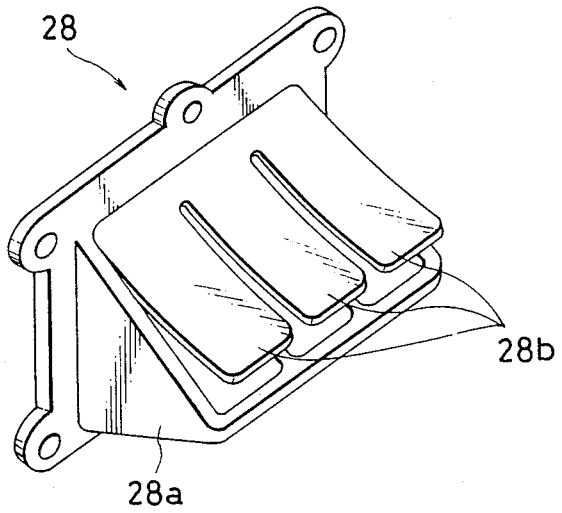
FIG. 7 is a perspective view of a reed valve.
Figure 8:
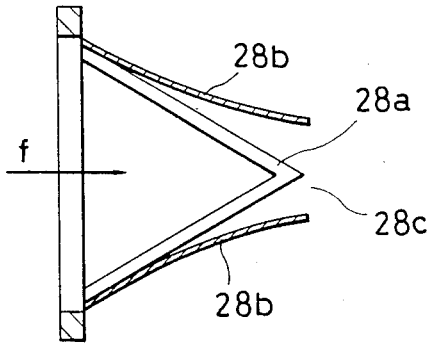
FIG. 8 is a cross-section view of the same read valve.

The reed valve 28 is a valve having a conventional structure, in which thin plate-shaped reeds **28*f* having resiliency are openably attached onto the both upper and lower surfaces of a support frame 28*a* of triangular shape as shown in FIG. 7, and when a pressure within a crank chamber has been lowered, the reeds 28*b* are sucked towards the side of the crank chamber and open as shown in FIG. 8, and hence the air within the air intake passageway 9*a* is sucked through an aperture section 28*c*** into the crank chamber.

As described above, when the reed valve 28 has opened, fuel of the amount corresponding to a desired feed amount is injected from the injection port 65, and as shown by an arrow *f* in FIG. 8, this fuel is injected directly aiming at the aperture section **28*c*. Upon low speed rotation of the engine 1, only the front fuel injection valve 14*a*, for instance, feeds fuel, and as the rotational speed rises, the injection valve opening period becomes long. If the engine rotate at a further high speed, the rear fuel injection valve 14*b*** would additionally feed fuel. Upon the highest output rotation, both injection valves would feed fuel at the largest rate.

Thus, in the illustrated embodiment, since the fuel injected from the fuel injection valve 14 directly enters into the crank chamber through the aperture section **28*c* of the reed valve 28 rather than after it has once struck against the inner wall of the air intake passageway 9*a* it is carried into the crank chamber by an intake air flowing through the air intake passageway 9*a*** as is the case with the prior art engine, the injected mistified fuel can be efficiently and surely fed to the engine.

In addition, it would never occur that fuel stagnated within the intake air passageway **9*a* is blown back towards the air intake 11 by an inverse flow from the side of the crank chamber immediately before the reed valve 28** is closed.

Furthermore, response of the engine to fuel feed is excellent, and breathing phenomena caused by delay of fuel when the throttle valve 12 has opened abruptly, can be effectively prevented.

While two fuel injection valves **14*a* and 14*b*** were provided for one air intake passageway in the illustrated embodiment, in the case where an air intake passageway is provided with a single fuel injection valve, preferably the axis of the fuel injection port is directed to the center of the reed valve.

What is claimed is:

1. A two-cycle engine for motorcycles, wherein at least one fuel injection valve for injecting fuel into an air intake passageway at a predetermined timing is disposed on the upstream side at at least one end transverse to the longitudinal side of a reed valve defining an elongated aperture in the air intake passageway communicating with an interior of the engine via said reed valve, with the injection port thereof directed toward said elongated aperture, said reed valve opened by reduced pressure within said engine.

2. A two-cycle engine for motorcycles as claimed in claim 1, wherein two fuel injection valves are disposed at said air intake passageway as opposed to each other, and fuel is injected from the respective fuel injection valves towards said reed valve in a diagonal manner.

3. A two-cycle engine for motorcycles as claimed in claim 1, which comprises a plurality of cylinders, a plurality of crank chambers partitioned within a crank case in correspondence to the respective cylinders, and a plurality of air intake passageways connected to the respective crank chambers respectively via reed valves.

4. A two-cycle engine for motorcycles as claimed in claim 1, wherein said air intake passageway is formed in a throttle body supported from a crankcase and provided with a throttle valve.

5. A two-cycle engine for motorcycles, comprising a crankshaft extending within a crankcase in the widthwise direction of a vehicle body, a transmission shaft extending within the crankcase in the widthwise direction of the vehicle body as separated from said crankshaft in the back and forth direction, an air intake pipe extending nearly in the vertical direction from the upper surface of said crankcase at a middle position between said crankshaft and said transmission shaft, a fuel injection valve mounted to said air intake pipe extending in the back and forth direction and a reed valve in said intake pipe downstream of said fuel injection valve opened by reduced pressure within said crankcase.

6. A two-cycle engine for motorcycles as claimed in claim 5, wherein said air intake pipe and said fuel injection valve are positioned between left and right vehicle body frame members above the engine.

7. A two-cycle engine for motorcycles as claimed in claim 6, wherein said vehicle body frame members are left and right main frame members extending backwards from a head pipe, and the engine is supported from these main frame members.

8. A two-cycle engine for motorcycles as claimed in claim 5, wherein a plurality of air intake pipes arrayed in the widthwise direction of the vehicle body are positioned between left and right vehicle body frame members above the engine.

9. A two-cycle engine for motorcycles as claimed in claim 5 or 8, wherein a fuel injection valve protruding forwards from said air intake pipe and another fuel injection valve protruding backwards are mounted to said air intake pipe.

10. A two-cycle engine for motorcycles as claimed in claim 5, wherein a fuel pump driven by said crank shaft is provided on a side cover covering a side portion of said crank case.

11. A two-cycle engine for motorcycles as claimed in claim 9, wherein a fuel feed pipe is arranged in U-shape so as to surround said air intake pipe, and connecting tubes for connecting said fuel feed pipe with said fuel injection valve protruding forwards and said fuel injection valve protruding backwards are respectively branched from said fuel feed pipe.

12. A two-cycle engine for motorcycles as claimed in claim 6, wherein a partition plate is provided between said vehicle body frame members and an engine main body.

* * * * *